US008475012B2

(12) United States Patent
Nakano et al.

(10) Patent No.: US 8,475,012 B2
(45) Date of Patent: Jul. 2, 2013

(54) LAMP

(75) Inventors: Nao Nakano, Tokyo (JP); Hiroyuki Chikama, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 738 days.

(21) Appl. No.: 12/630,834

(22) Filed: Dec. 3, 2009

(65) Prior Publication Data

US 2010/0149803 A1 Jun. 17, 2010

(30) Foreign Application Priority Data

Dec. 11, 2008 (JP) ..... 2008-316045

(51) Int. Cl.
*F21V 7/00* (2006.01)

(52) U.S. Cl.
USPC ..... 362/346; 362/240; 362/241; 362/242; 362/243; 362/245; 362/247; 362/296.05; 362/297; 362/298; 362/343; 362/328

(58) Field of Classification Search
USPC ..... 362/240, 241, 242, 243, 245, 247, 362/296.05, 297, 298, 343, 346, 328
See application file for complete search history.

(56) References Cited

U.S. PATENT DOCUMENTS 5,136,483 A * 8/1992 Schoniger et al. ..... 362/545
5,838,247 A * 11/1998 Bladowski ..... 340/815.45
6,464,373 B1 * 10/2002 Petrick ..... 362/235
6,988,815 B1 * 1/2006 Rizkin et al. ..... 362/245
7,237,927 B2 * 7/2007 Coushaine et al. ..... 362/554
7,461,951 B2 * 12/2008 Chou et al. ..... 362/294
7,506,985 B2 * 3/2009 Radominski et al. ..... 353/94
7,922,355 B1 * 4/2011 Morejon et al. ..... 362/247
8,123,377 B2 * 2/2012 Lundberg et al. ..... 362/243
8,172,432 B2 * 5/2012 Liu ..... 362/308
2003/0142505 A1 * 7/2003 Ter-Oganesian ..... 362/488
2004/0090602 A1 * 5/2004 Imade ..... 353/102
2005/0243560 A1 * 11/2005 Chen ..... 362/328
2007/0147036 A1 * 6/2007 Sakai et al. ..... 362/240
2008/0158879 A1 * 7/2008 Sun et al. ..... 362/240
2009/0147525 A1 * 6/2009 Lai ..... 362/297

FOREIGN PATENT DOCUMENTS

JP 2002-343111 A 11/2002

* cited by examiner

*Primary Examiner* — Mary McManmon

(74) *Attorney, Agent, or Firm* — Kenealy Vaidya LLP

(57) ABSTRACT

A lamp can includes: a first reflective surface which can be provided on a surface of a circular shaped member, a radius of a top of the annular member can be longer than a radius of a bottom of the annular member; a second reflective surface which can be arranged inside of the first reflective surface and can have a conical shape, a vertex of the second reflective surface can be directed to a top side of the first reflective surface; and a plurality of light emitters which can be annularly arranged on the first reflective surface around the second reflective surface at a predetermined interval so as to be projected on the second reflective surface.

8 Claims, 18 Drawing Sheets

LAMP

This application claims the priority benefit under 35 U.S.C. §119 of Japanese Patent Application No. 2008-316045 filed on Dec. 11, 2008, which is hereby incorporated in its entirety by reference.

BACKGROUND

1. Technical Field

The presently disclosed subject matter relates to a lamp, and more particularly to a lamp having a new light emission appearance applicable to a vehicle signal lamp, general illumination other than the vehicle signal lamp, or the like.

2. Description of the Related Art

Conventionally, a vehicle lamp including a convex reflective surface has been known (for example, see Japanese Patent Application Laid-Open No. 2002-343111).

FIG. 18 is a sectional view for illustrating a configuration of a vehicle lamp described in Japanese Patent Application Laid-Open No. 2002-343111.

As shown in FIG. 18, the vehicle lamp 200 described in Japanese Patent Application Laid-Open No. 2002-343111 includes a convex reflective surface 210 placed at a center of the lamp 200, a plurality of LED (Light Emitting Diode) light sources 220 annularly arranged around the convex reflective surface 210, a front lens 230.

In the vehicle lamp 200 described in Japanese Patent Application Laid-Open No. 2002-343111, the convex reflective surface 210 is formed as a paraboloidal reflective surface obtained by rotating a parabola C having a focus set near the LED light source 220 around an optical axis AX. Thus, an irradiation light from the LED light source 220 having reached the convex reflective surface 210 is converted into parallel rays by the convex reflective surface 210, and the rays pass through the front lens 230 and are irradiated in a direction indicated by arrows in FIG. 18.

SUMMARY

However, in the vehicle lamp 200 described in Japanese Patent Application Laid-Open No. 2002-343111, as shown in FIG. 18, the convex reflective surface 210 is a substantially conical reflective surface with the parabola C, which is a curved line recessed outwardly, appearing when cut along a plane through a vertex of the surface 210. Thus, the LED light source 220 is hardly (or extremely slightly) projected on the convex reflective surface 210. Accordingly, the vehicle lamp 200 described in Japanese Patent Application Laid-Open No. 2002-343111 has a uniform light emission appearance of the LED light source 220, and there is a problem that it is difficult to provide a lamp having a new light emission appearance.

The presently described subject matter is achieved in view of such circumstances, and can include a lamp which forms a pattern with an appearance changing according to viewpoint positions of an observer and has a new light emission appearance.

To achieve this, an aspect of the presently described subject matter provides a lamp that can include: a first reflective surface which can be provided on a surface of a circular shaped member, a radius of a top of the annular member can be longer than a radius of a bottom of the annular member; a second reflective surface which can be arranged inside of the first reflective surface and can have a conical shape, a vertex of the second reflective surface can be directed to a top side of the first reflective surface; and a plurality of light emitters which can be annularly arranged on the first reflective surface around the second reflective surface at a predetermined interval so as to be projected on the second reflective surface.

Another aspect of the presently described subject matter provides a lamp, wherein the first reflective surface can be formed as a flat surface, a cross-section view of the flat surface along a lamp optical axis passing through a vertex of the second reflective surface can be a straight line, or a concave surface, a cross-section view of the concave surface along the lamp optical axis can be a curved line that can be concave inward with respect to a center thereof.

Another aspect of the presently described subject matter provides a lamp, wherein the second reflective surface can be formed as a flat surface, a cross-section view of the flat surface along a lamp optical axis passing through a vertex of the second reflective surface can be a straight line, or a convex surface, a cross-section view of the convex surface can be a curved line that can be convex outward with respect to a center thereof.

The second reflective surface can be formed as the convex reflective surface with the curved line protruding outwardly, or a flat surface with the straight line appearing when cut along the plane through the lamp optical axis. Thus, the plurality of light emitters can be projected on the second reflective surface, and a virtual image projected on the second reflective surface can be enlarged (or not reduced). Therefore, a pattern with an appearance changing according to viewpoint positions of the observer can be formed. Specifically, a lamp can be provided which can form a pattern with an appearance changing according to viewpoint positions and can have a new light emission appearance.

Another aspect of the presently described subject matter provides a lamp, wherein each of the plurality of light emitters can include: a lens which can be set in an aperture provided on the first reflective surface; a first light source which can correspond to the lens, and can be arranged at a back side of the first reflective surface; and a third reflective surface which can correspond to the lens, can be arranged at the back side of the first reflective surface, and can reflect a light irradiated from the first light source to make the light reach the second reflective surface.

Another aspect of the presently described subject matter provides a lamp, wherein the lens can include a first end portion which can be acute-angled; and a second end portion which can be on the opposite side with respect to the first end portion, and can be arranged so that the first end portion can be located closer to the top of the first reflective surface, and the second end portion can be located closer to the bottom of the first reflective surface.

The first end portion of the lens can be located closer to the top of the first reflective surface, and thus the first end portion can be projected on a tip (at or in vicinity of the vertex) of the second reflective surface. Thus, a virtual image of the first end portion having a very sharp shape can be enlarged, and a pattern with an appearance significantly changing by slight movement of the eyes of an observer can be formed. Specifically, a lamp can be provided that can form a pattern with an appearance significantly changing by slight movement of the viewpoint position, and can have a new light emission appearance.

Another aspect of the presently described subject matter provides a lamp, wherein the first light source can irradiate the light outwardly with respect to a center of the lamp.

Another aspect of the presently described subject matter provides a lamp, wherein the first light source can be an LED light source.

The second reflective surface can be formed as the convex reflective surface with the curved line protruding outwardly or a flat surface with the straight line appearing when cut along the plane through the lamp optical axis. Thus, the plurality of lenses illuminated by a plurality of first light sources (for example, LED light sources) can be projected on the second reflective surface. Thus, a virtual image projected on the second reflective surface can be enlarged (or not reduced), and a pattern with an appearance changing according to viewpoint positions can be formed. Specifically, the lamp can be provided which can form a pattern with an appearance changing according to viewpoint positions and can have a new light emission appearance.

The convex reflective surface can be formed as the convex reflective surface with a curved line protruding outwardly (or a straight line) appearing when cut along the plane through the vertex and the lamp optical axis. Thus, the plurality of light emitters can be projected on the convex reflective surface, a virtual image projected on the convex reflective surface can be enlarged (or not reduced), and a pattern with an appearance changing according to viewpoint positions can be formed.

Another aspect of the presently described subject matter provides a lamp that can include a plurality of fourth reflective surfaces each of which can correspond to the first light source, can be arranged at the back side of the first reflective surface, and can reflect the light irradiated from the first light source to make the light be directed along the lamp optical axis.

Also, the irradiation light emitted from the first light source and having reached the fourth reflective surface can be reflected by the fourth reflective surface and can be irradiated through the corresponding lens, and can form a first light distribution pattern (particularly a light distribution pattern suitable for a vehicle signal lamp). Also, the irradiation light emitted from the first light source and having reached the third reflective surface can be reflected by the third reflective surface, can pass through the corresponding lens, and can reach the second reflective surface. The irradiation light having reached the second reflective surface can be further reflected by the second reflective surface, and can form a second light distribution pattern (particularly a light distribution pattern suitable for a wide vehicle signal lamp enlarged by the convex reflective surface) superimposed on the first light distribution pattern.

Specifically, a lamp can be provided which can form a pattern with an appearance changing according to viewpoint positions, and can form a predetermined light distribution pattern (particularly a light distribution pattern suitable for a vehicle signal lamp) (combination of a new appearance and a predetermined light distribution pattern).

The acute-angled first end portion of the lens can be located closer to the top of the first reflective surface, and thus the first end portion can be projected on a tip of the second reflective surface. Thus, a virtual image of the first end portion having a very sharp shape can be enlarged (or not reduced), and a pattern with an appearance significantly changing by slight movement of the viewpoint position can be formed. Specifically, a lamp can be provided which can form a pattern with an appearance significantly changing by slight movement of the viewpoint position, can form a predetermined light distribution pattern (particularly a light distribution pattern suitable for a vehicle signal lamp), and can have a new light emission appearance.

Another aspect of the presently described subject matter provides a lamp that can include: a plurality of second light sources which can be arranged at a back side of the second reflective surface; and a plurality of fifth reflective surfaces each of which can correspond to the second light sources, can be arranged at a back side of the second reflective surface, and can reflect the light irradiated from the second light source to make the light be directed along the lamp optical axis, wherein the second reflective surface can transmit the light from the back side thereof.

Another aspect of the presently described subject matter provides a lamp, wherein the second light sources can be annularly arranged around a lamp optical axis at a predetermined interval, and can irradiate the light inwardly with respect to a center of the lamp.

The second reflective surface can be formed as the reflective surface through which the reflected light from the fifth reflective surfaces having reached the second reflective surface can pass. Thus, the irradiation light emitted from the second light source and having reached the fifth reflective surface can be reflected by the fifth reflective surface and irradiated through the second reflective surface, and can form a third light distribution pattern (particularly a light distribution pattern suitable for a vehicle signal lamp) superimposed on the first and second light distribution patterns.

Specifically, the third light distribution pattern formed by the irradiation light from the second light source can be added to the first and second light distribution patterns formed by the irradiation lights from the first light source. Thus, for example, when these aspects are applied to a tail lamp of a vehicle, the light sources can be controlled to turn on only the first light source when a brake of the vehicle is not applied, and to turn on both the first light source and the second light source when the brake is applied. Thus, a sufficient amount of light can be ensured even when the brake is applied, thereby allowing formation of a light distribution pattern that can satisfy a government standard.

According to an aspect of the disclosed subject matter, a lamp can include a first reflective surface located on a surface of an annular shaped member, a radius of a top of the annular shaped member being longer than a radius of a bottom of the annular shaped member, a second reflective surface located inside of the first reflective surface and having a conical shape, a vertex of the second reflective surface being directed to the top of the first reflective surface. The lamp can include a plurality of light emitters annularly arranged on the first reflective surface around the second reflective surface at a predetermined interval and arranged to project light on the second reflective surface.

According to another aspect of the disclosed subject matter, a lamp having an optical axis can include a first annular reflector having an outer perimeter, a front surface extending at an angle relative to the optical axis and a back surface opposite to the front surface. A second reflector can be located within the outer perimeter of the first annular reflector and can have a convex surface facing the first annular reflector. The second reflector can include a vertex adjacent to the optical axis and the second reflector can extend between the optical axis and the front surface of the first annular reflector. A first plurality of semiconductor light emitters can be located adjacent to at least one of the front surface and the back surface of the first annular reflector, spaced annularly about the optical axis, and configured to project light onto the convex surface of the second reflector.

According to another aspect of the disclosed subject matter, the front surface of the first annular reflector can abut the convex surface of the second reflector.

According to another aspect of the disclosed subject matter, the convex surface can be either conical or polygonal pyramidal.

According to another aspect of the disclosed subject matter, the convex surface can appear as an outwardly curved line when viewed in a cross-sectional plane that includes the optical axis and the vertex.

According to another aspect of the disclosed subject matter, each of the light emitters can include an LED light source adjacent to the front surface of the first reflector such that an image of the LED light source is reflected in the convex surface.

According to another aspect of the disclosed subject matter, each of the light emitters can include an LED light source adjacent to the back surface of the first reflector, and a lens adjacent to the front surface of the first reflector such that an image of the lens is reflected in the convex surface.

According to another aspect of the disclosed subject matter, the lamp can include a third reflector positioned such that the back surface of the first reflector lies intermediate the front surface of the first reflector and the third reflector. Each of the LED light sources can be configured to emit light toward the third reflector.

According to another aspect of the disclosed subject matter, the third reflector can include a first plurality of reflector surfaces and a second plurality of reflector surfaces, each of the LED light sources corresponding to one of the first plurality of reflector surfaces and the second plurality of reflector surfaces. The light emitted from each of the LED light sources and incident on a respective one of the first plurality of reflector surfaces can be directed substantially parallel with the optical axis, and light emitted from each of the LED light sources and incident on a respective one of the second plurality of reflector surfaces can be incident on the convex surface of the second reflector.

According to another aspect of the disclosed subject matter, the lamp can include a second plurality of semiconductor light emitters adjacent to the back surface of the first reflector and configured to emit light in a radially inward direction relative to the optical axis, and a fourth reflector facing a side of the second reflector that is opposite to the convex surface relative to the optical axis. The fourth reflector can include a fourth plurality of reflective surfaces each corresponding to a respective one of the second plurality of semiconductor light emitters. The first plurality of semiconductor light emitters can be configured to emit light in a radially outward direction relative to the optical axis. The fourth reflector can be oriented relative to the second plurality of semiconductor light emitters such that light emitted from the second plurality of semiconductor light emitters is incident on the fourth reflector surface and is directed substantially parallel with the optical axis.

According to another aspect of the disclosed subject matter, each of the second plurality of semiconductor light emitters can be located adjacent, and in a back to back relationship with, a respective one of the first plurality of semiconductor light emitters, such that each of the first plurality of semiconductor light emitters has a light emitting axis that is diametrically opposite to a light emitting axis of a respective one of the second plurality of semiconductor light emitters.

According to the presently described subject matter, a lamp can be provided which can form a pattern with an appearance changing according to viewpoint positions and has a new light emission appearance.

BRIEF DESCRIPTION OF THE DRAWINGS

The disclosed subject matter of the present application will now be described in more detail with reference to exemplary embodiments of the apparatus and method, given by way of example, and with reference to the accompanying drawings, in which.

DETAILED DESCRIPTION OF EXEMPLARY EMBODIMENTS

Now, a lamp according to an embodiment of the presently described subject matter will be described with reference to the drawings.

Figure 1:
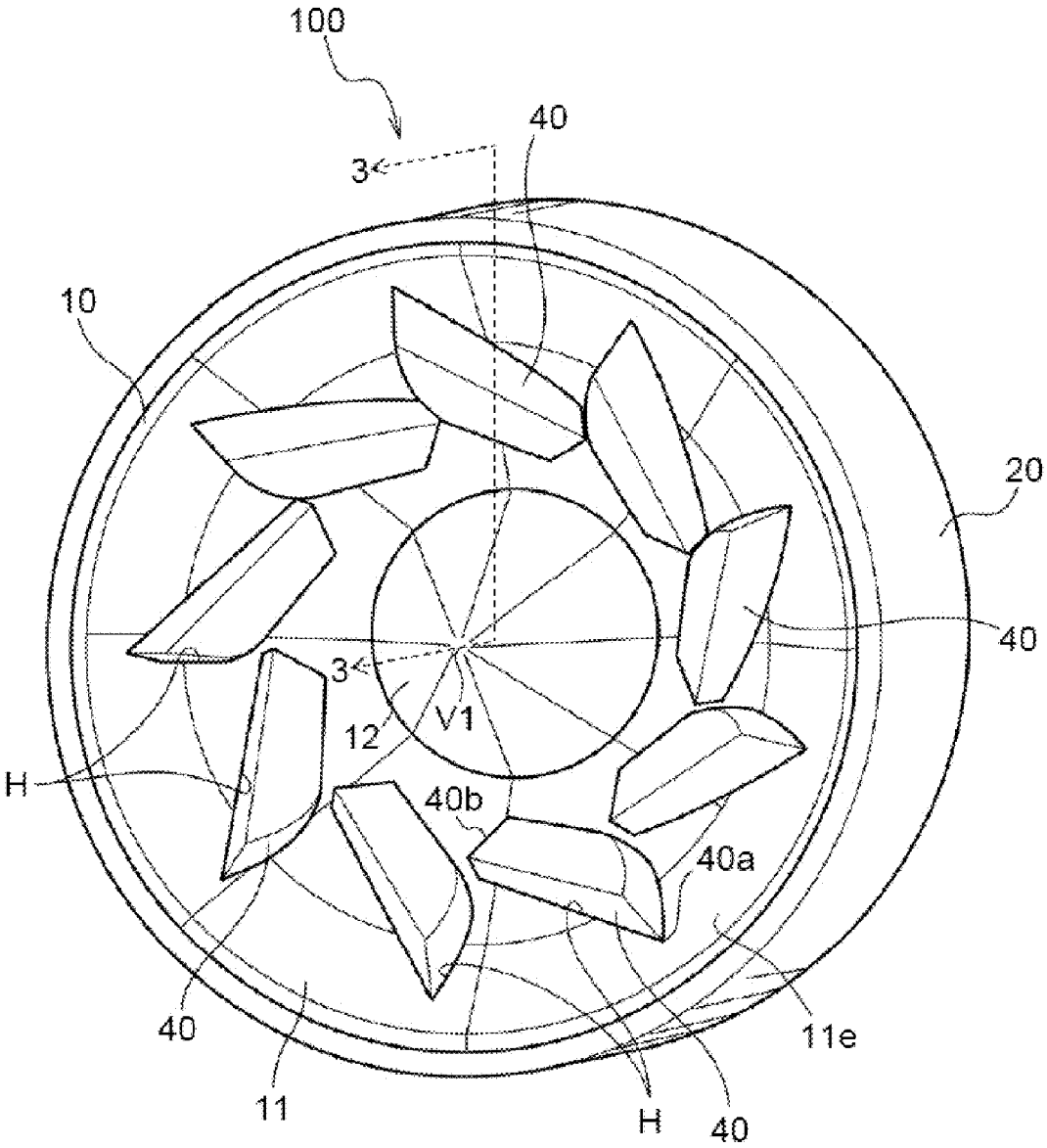
FIG. 1 is a perspective view of a lamp according to an embodiment of the presently described subject matter.
Figure 2:
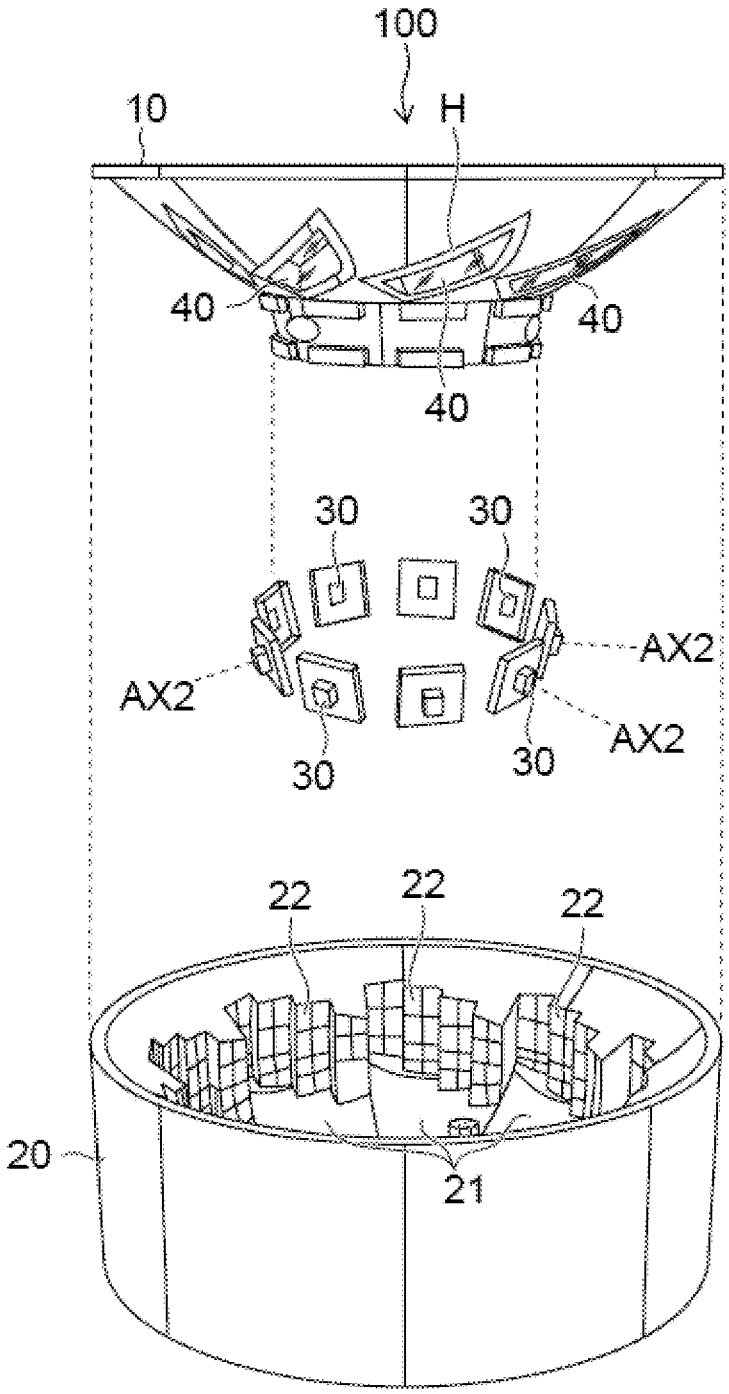
FIG. 2 is an exploded perspective view of components of the lamp shown in FIG. 1.
Figure 3:
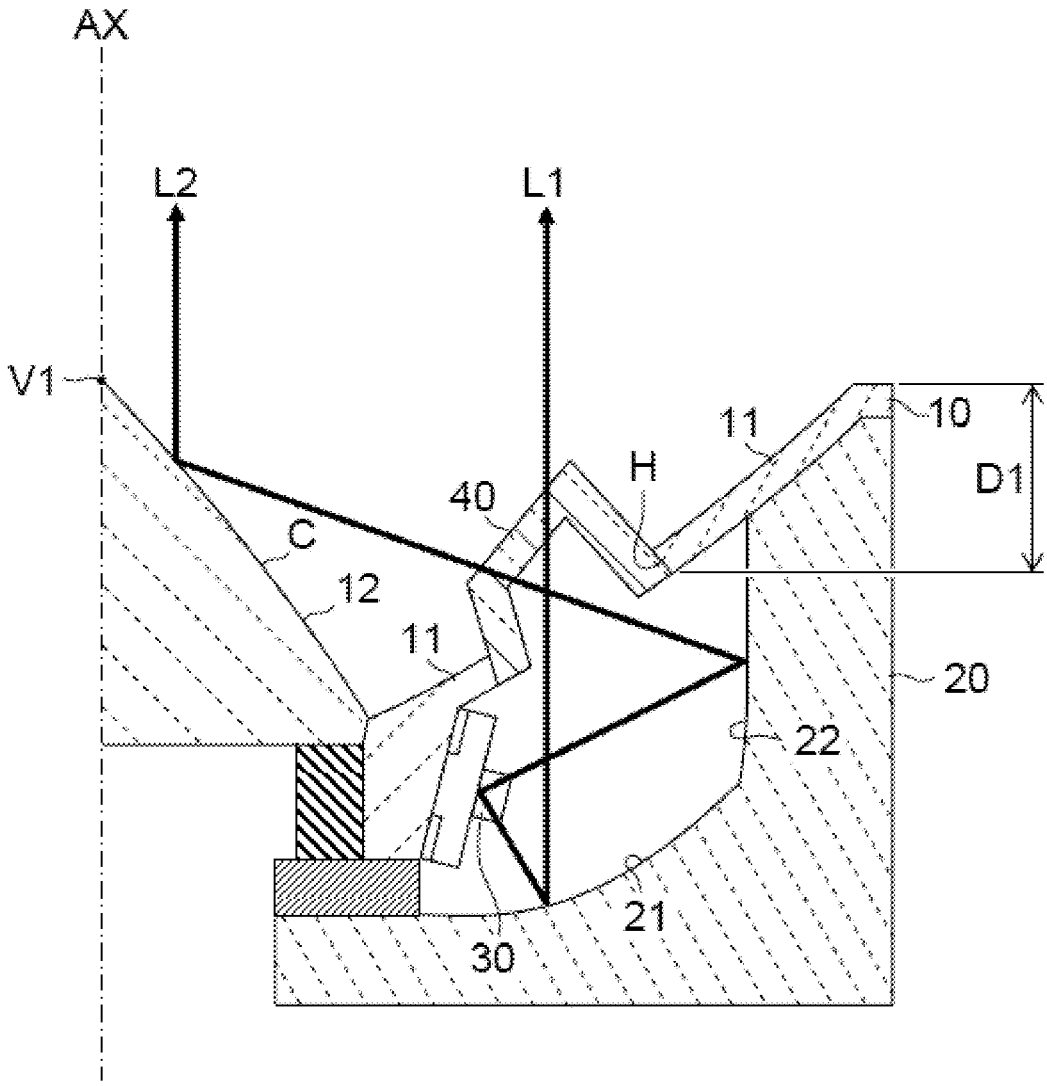
FIG. 3 is an enlarged sectional view of the lamp along line 3-3 shown in FIG. 1.

FIG. 1 is a perspective view of a lamp according to an embodiment of the presently described subject matter. FIG. 2 is an exploded perspective view of components of the lamp shown in FIG. 1. FIG. 3 is an enlarged sectional view of the lamp shown in FIG. 1.

A lamp 100 of this embodiment can be applied to a vehicle signal lamp such as a tail lamp, turn signal, and a general illumination lamp other than a vehicle signal lamp, or the like. The lamp 100 can include a first reflector 10, a second reflector 20, a plurality of first light sources 30, a plurality of inner lenses 40, as shown in FIGS. 1 and 2.

First, the first reflector 10 will be described.

As shown in FIGS. 1 to 3, the first reflector 10 can include a concave reflective surface 11 and a convex reflective surface 12.

The concave reflective surface 11 can be a concave mirror (for example, a paraboloid of revolution) having, for example, a substantially circular shape when viewed from the front, and a predetermined depth D1 (for example, D1=15 mm. See FIG. 3). As shown in FIG. 3, the convex reflective surface 12 can be a conical reflective surface with a curved line C appearing to protrude outwardly (or a straight line) when cut along a plane passing through a vertex V1 and a lamp optical axis AX (centerline). Alternatively, the reflective surface can appear as a straight line, instead of as a curved line, when viewed in this cross-section. The convex reflective surface 12 can be adjacent the center of a bottom of the concave reflective surface 11, as shown in FIG. 1. The shape of the convex reflective surface 12 can be determined as described later, for example, using an existing computer program.

Next, the second reflector 20 will be described.

As shown in FIGS. 2 and 3, the second reflector 20 can include a first reflective surface 21 and a second reflective surface 22.

As shown in FIG. 3, the first reflective surface 21 can reflect an irradiation light L1 incident from the first light source 30 toward the inner lens 40 corresponding with the respective first reflective surface 21. The first reflective surface 21 can be placed, for example, adjacent to a bottom surface of the second reflector 20. The first reflective surface 21 can be a paraboloid of revolution obtained by, for example, rotating a parabola having a focus positioned at or adjacent to the first light source 30 around the lamp optical axis AX.

As shown in FIG. 3, the second reflective surface 22 can reflect an irradiation light L2 incident from the first light source 30 toward the convex reflective surface 12 via the inner lens 40 corresponding with the respective second reflective surface 22. The second reflective surface 22 can be arranged, for example, on an inner side surface of the second reflector 20.

Next, the first light source 30 will be described.

The first light source 30 can be, for example, an LED light source such as an LED package including one or more LED chips (monochrome or three color RGB) in a package, or a bulb light source such as an incandescent light bulb. When the first light source 30 is an LED light sources, for example, the first light sources 30 can be annularly arranged between the first reflector 10 and the second reflector 20 with their respective optical axis (illumination direction) AX2 directed outward along a radial direction of the lamp 100 with respect to the center of the lamp 100, as shown in FIG. 2.

Next, the inner lens 40 will be described.

The inner lens 40 can be a light illumination unit which can receive the irradiation light from the first light source 30 and can transmit the light incident thereon. The inner lens 40 can be, for example, integrally manufactured by injection molding a transparent or translucent material such as acryl or polycarbonate. The inner lens 40 can have a surface subjected to a diffusion process such as embossing. The inner lens 40 can include, for example, as shown in FIG. 1, an acute-angled end 40*a* and an end 40*b* on the opposite side of the acute-angled end 40*a*. The inner lenses 40 can be annularly arranged on the concave reflective surface 11 around the convex reflective surface 12 so as to be projected on the convex reflective surface 12. Specifically, as shown in FIG. 1, the inner lenses 40 can be inserted into openings H formed in the concave reflective surface 11 so that the acute-angled end 40*a* can be located closer to an outer peripheral edge 11*e* of the concave reflective surface 11, and the end 40*b* on the opposite side can be located closer to the center of the bottom of the concave reflective surface 11. And, the inner lenses 40 can be placed substantially at circumferentially regular intervals.

Next, a method of determining the convex reflective surface 12 will be described. The convex reflective surface 12 can be, for example, determined using an existing computer program for an optical design as described below.

FIGS. 4-7 illustrate the method of calculating the shape of the convex reflective surface 12. FIGS. 4-7 show the shape of a pattern P1 formed by a virtual image projected on the convex reflective surface 12 calculated by the computer program for the optical design.

Figure 4:
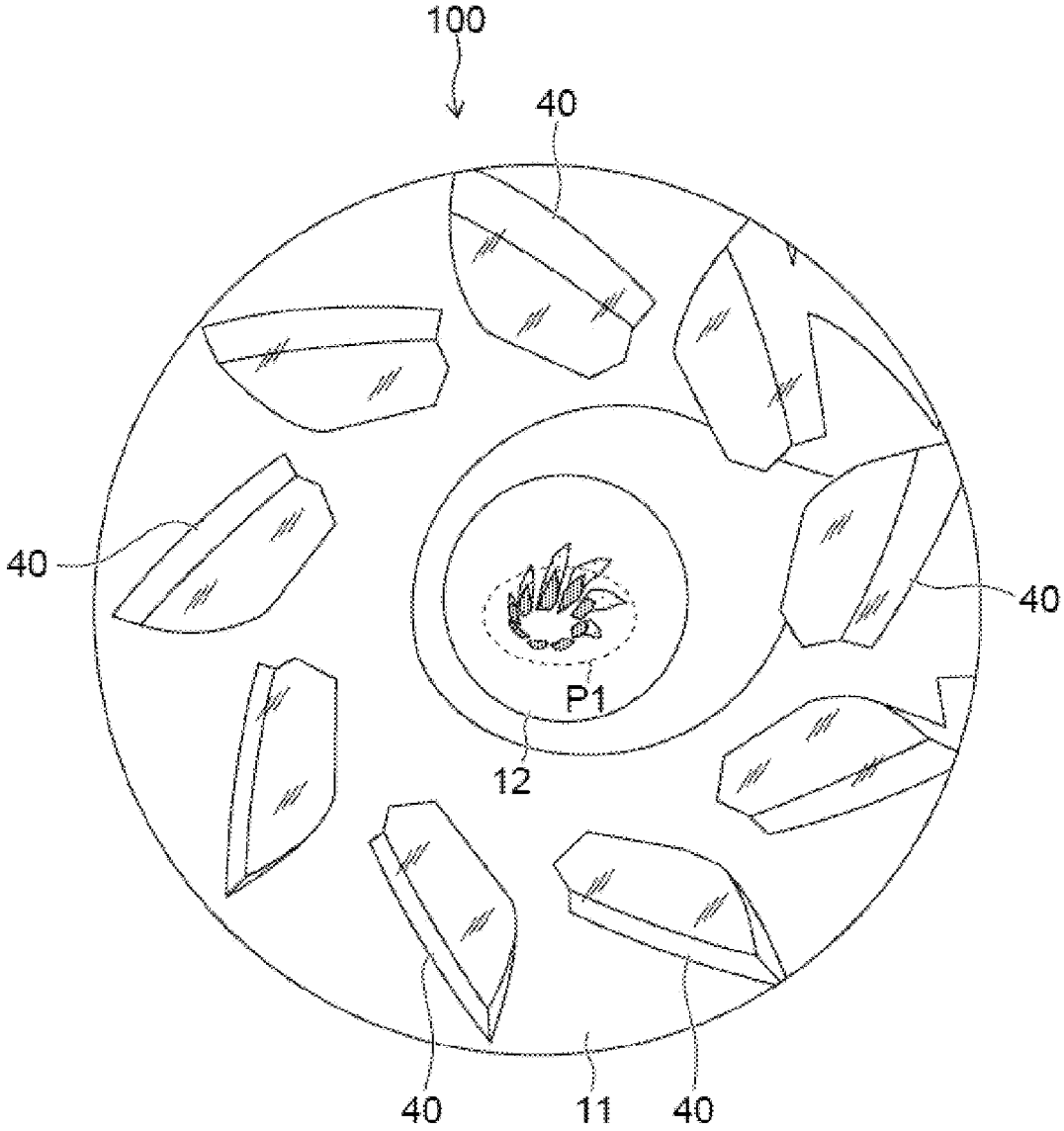
FIG. 4 illustrates a method of calculating the shape of a convex reflective surface.

First, as shown in FIG. 4, the shapes of the reflective surfaces (such as the concave reflective surface 11 and the convex reflective surface 12) can be determined, and the reflective surfaces (such as the concave reflective surface 11 and the convex reflective surface 12) and the inner lenses 40 can be arranged. FIG. 4 shows an example in which a recessed mirror shape having a predetermined depth D1 (for example, D1=15 mm, See FIG. 3) can be used as the concave reflective surface 11, and a conical shape can be used as the convex reflective surface 12.

Figure 5:
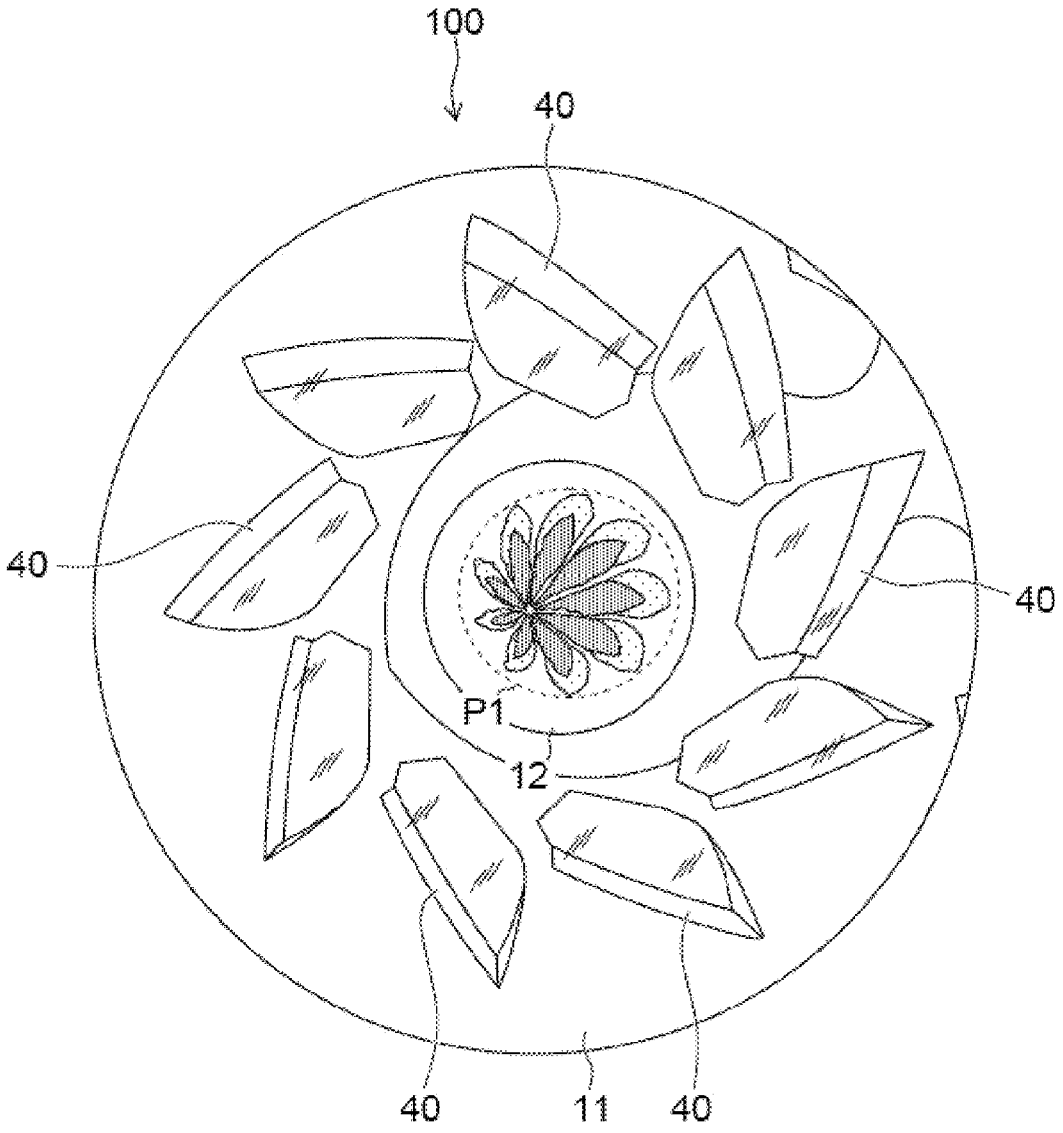
FIG. 5 illustrates the method of calculating the shape of the convex reflective surface.
Figure 6:
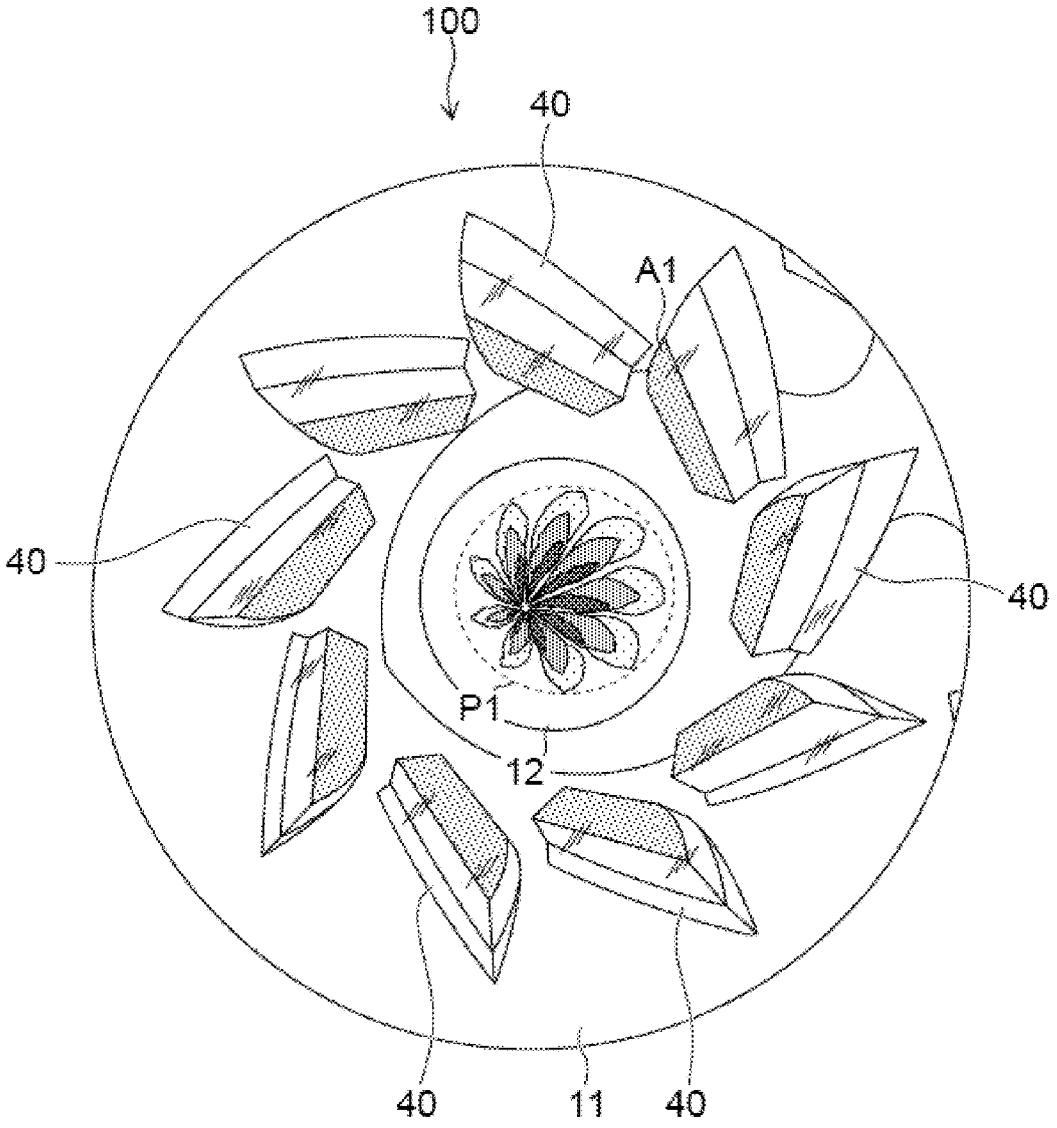
FIG. 6 illustrates the method of calculating the shape of the convex reflective surface.
Figure 7:
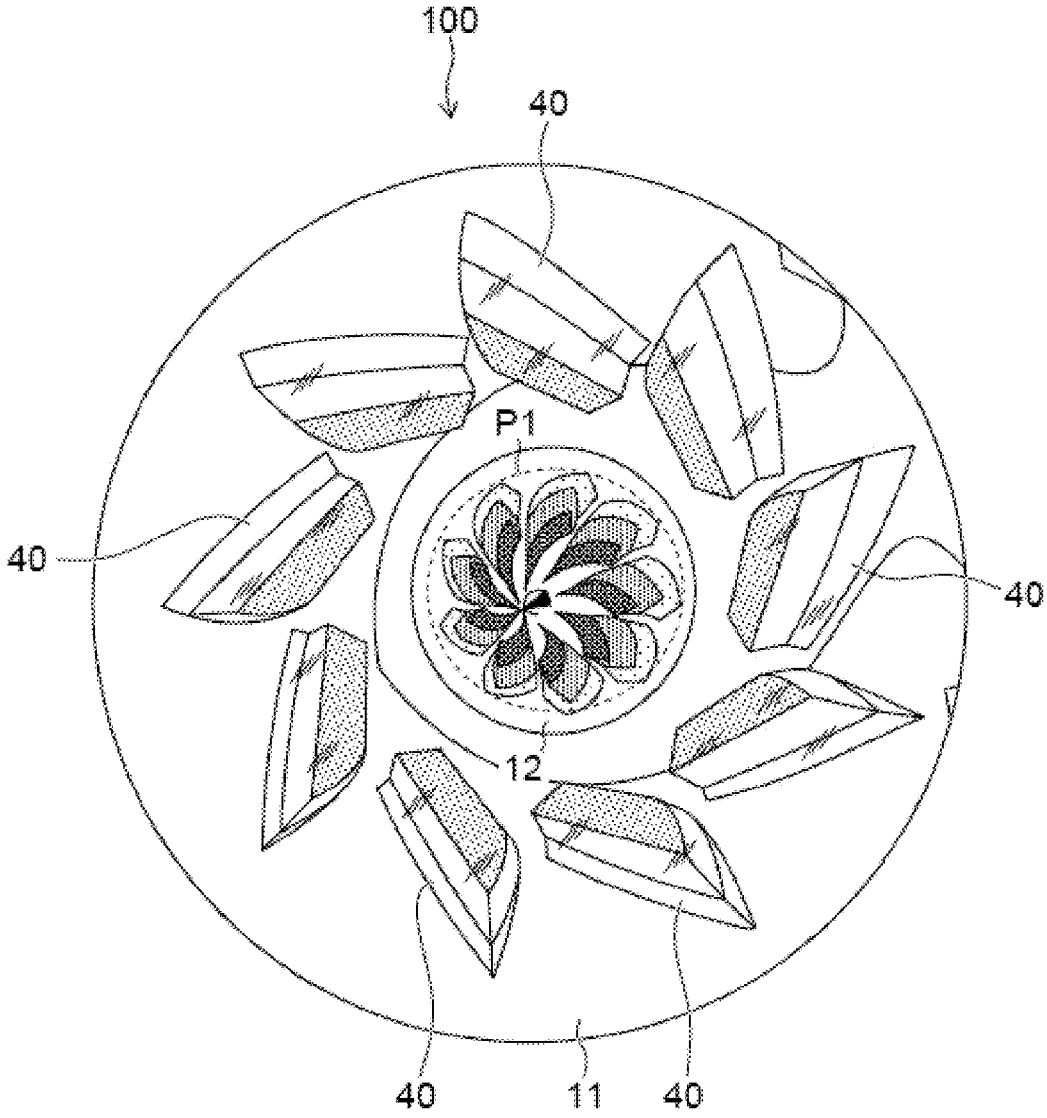
FIG. 7 illustrates the method of calculating the shape of the convex reflective surface.

Then, as shown in FIG. 5, the inner lenses 40 can be moved toward the center of the bottom of the concave reflective surface 11 to adjust a pattern formed by a virtual image projected on the convex reflective surface 12. Then, as shown in FIG. 6, a comparatively high brightness portion A1 of each inner lens 40 can be colored, for example, red, and the pattern P1 formed by the virtual image projected on the convex reflective surface 12 can be checked by an operator who manipulates the computer program or reviews the calculation result of the computer program. Then, as shown in FIG. 7, the convex reflective surface 12 can be curved outwardly with respect to the center thereof so that the pattern P1 formed by the virtual image projected on the convex reflective surface 12 becomes a desired size. Therefore, the pattern P1 formed by the virtual image projected on the convex reflective surface 12 can be enlarged. As described above, the shape of the convex reflective surface 12 on which the pattern P1 of the desired size is formed can be determined. Thus, the convex reflective surface 12 can be formed, as shown in FIG. 3, as a conical reflective surface with a curved line C protruding outwardly (or a straight line) with respect to the center of the convex reflective surface 12 appearing when cut along a plane passing through the vertex V1 of the convex reflective surface 12 and the lamp optical axis AX (centerline).

Figure 8:
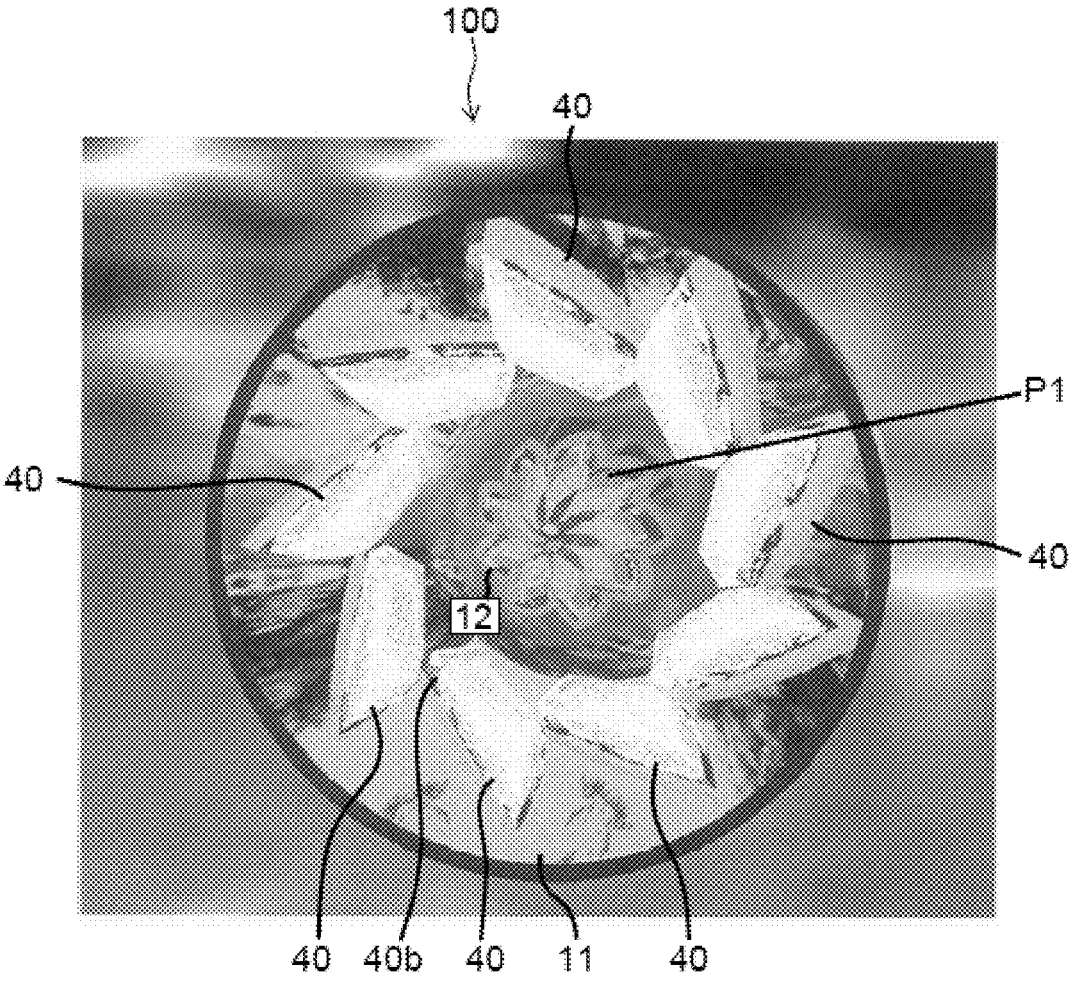
FIG. 8 is a front view of the lamp shown in FIG. 1, and shows an example of a pattern formed by a virtual image projected on a convex reflective surface when viewed from the front of the lamp.
Figure 9:
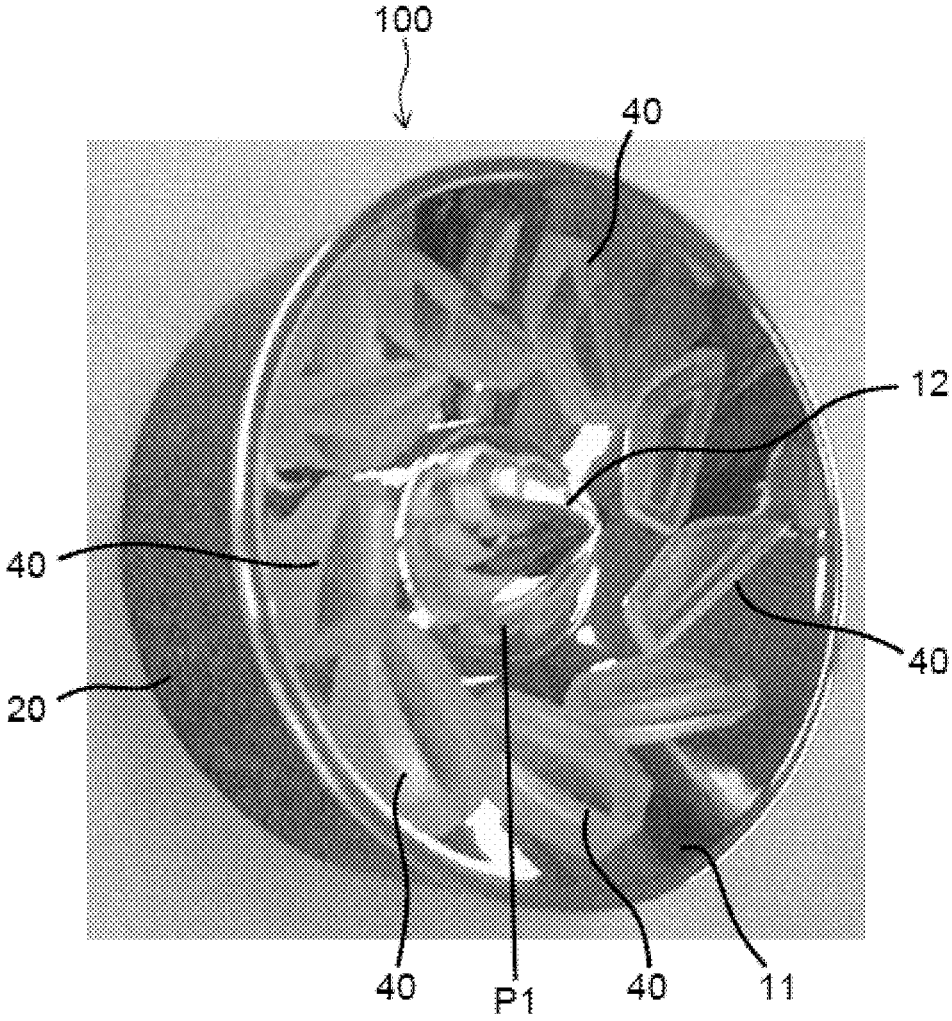
FIG. 9 is a perspective view of the lamp shown in FIG. 1, and shows an example of a pattern formed by the virtual image projected on the convex reflective surface when diagonally viewed.

As described above, according to the lamp 100 of this embodiment, as shown in FIG. 3, the convex reflective surface 12 can be formed as a conical convex reflective surface with the curved line C appearing to protrude outwardly with respect to the center of the convex reflective surface 12 when cut along the plane passing through the vertex V1 and the lamp optical axis AX. Thus, according to the lamp 100 of this embodiment, as shown in FIGS. 7 and 8, the plurality of inner lenses 40 can be projected on the convex reflective surface 12 in a multiplexed manner, and the virtual image projected on the convex reflective surface 12 can be enlarged, and a pattern P1 with an appearance changing according to viewpoint positions of an observer can be formed as shown in FIG. 9. Specifically, the number of the inner lenses 40 can appear to be doubled as a result of the pattern P1. The pattern P1 can be changed by changing the shape of the convex reflective surface 12.

Also, according to the lamp 100 of this embodiment, as shown in FIG. 3, the irradiation light L1 emitted from the first light source 30 and incident on the first reflective surface 21 can be reflected by the first reflective surface 21, can pass through the inner lens 40, can be irradiated in a direction indicated by L1 in FIG. 3, and can form a first light distribution pattern (particularly a light distribution pattern suitable for a vehicle signal lamp). Also, according to the lamp 100 of this embodiment, the irradiation light L2 emitted from the first light source 30 and incident on the second reflective surface 22 can be reflected by the second reflective surface 22, can pass through the inner lens 40, and can reach the convex reflective surface 12. The irradiation light L2 incident on the convex reflective surface 12 can be further reflected by the convex reflective surface 12 in a direction indicated by L2 in FIG. 3, and can form a second light distribution pattern (particularly a light distribution pattern suitable for a wide vehicle signal lamp enlarged by the convex reflective surface 12) superimposed on the first light distribution pattern.

Specifically, according to the lamp 100 of this embodiment, as shown in FIGS. 8 and 9, a lamp can be provided that can form a pattern P1 with an appearance changing according to the viewpoint positions of the observer, can form a predetermined light distribution pattern (particularly a light distribution pattern suitable for a vehicle signal lamp), and can have a new light emission appearance.

Also, according to the lamp 100 of this embodiment, as shown in FIG. 1, the acute-angled end 40*a* of the inner lens 40 can be located closer to the outer peripheral edge 11*e* of the concave reflective surface 11, and thus as shown in FIGS. 8 and 9, the acute-angled end 40*a* of the inner lens 40 can be projected adjacent to a tip portion (in the vicinity of the vertex V1) of the convex reflective surface 12. Thus, a virtual image having a very sharp shape can be enlarged. The pattern P1 formed on the convex reflective surface 12 can form an appearance that significantly changes by slight movement of an observer's eyes.

Specifically, according to the lamp 100 of this embodiment, a lamp can be provided that can form a pattern P1 with an appearance significantly changing by slight movement of eyes of the observer, can form a predetermined light distribution pattern (particularly a light distribution pattern suitable for a vehicle signal lamp), and can have a new light emission appearance (combination of a new appearance and a predetermined light distribution pattern).

Next, Modified Example 1 will be described.

In the above-described embodiment, the example in which the inner lenses 40 are annularly arranged on the concave reflective surface 11 around the convex reflective surface 12 (see FIG. 1) has been described, but the presently described subject matter is not limited thereto.

Figure 10:
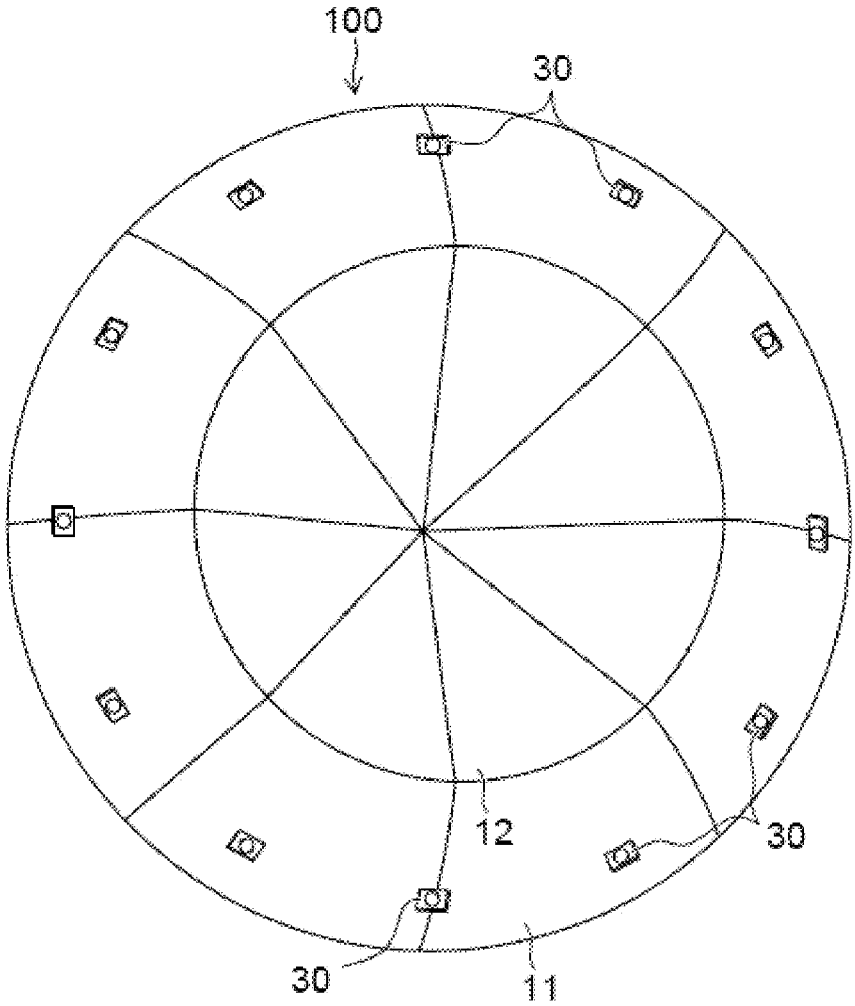
FIG. 10 is a perspective view of a lamp according to an another embodiment (Modified Example 1) of the presently described subject matter.
Figure 11:
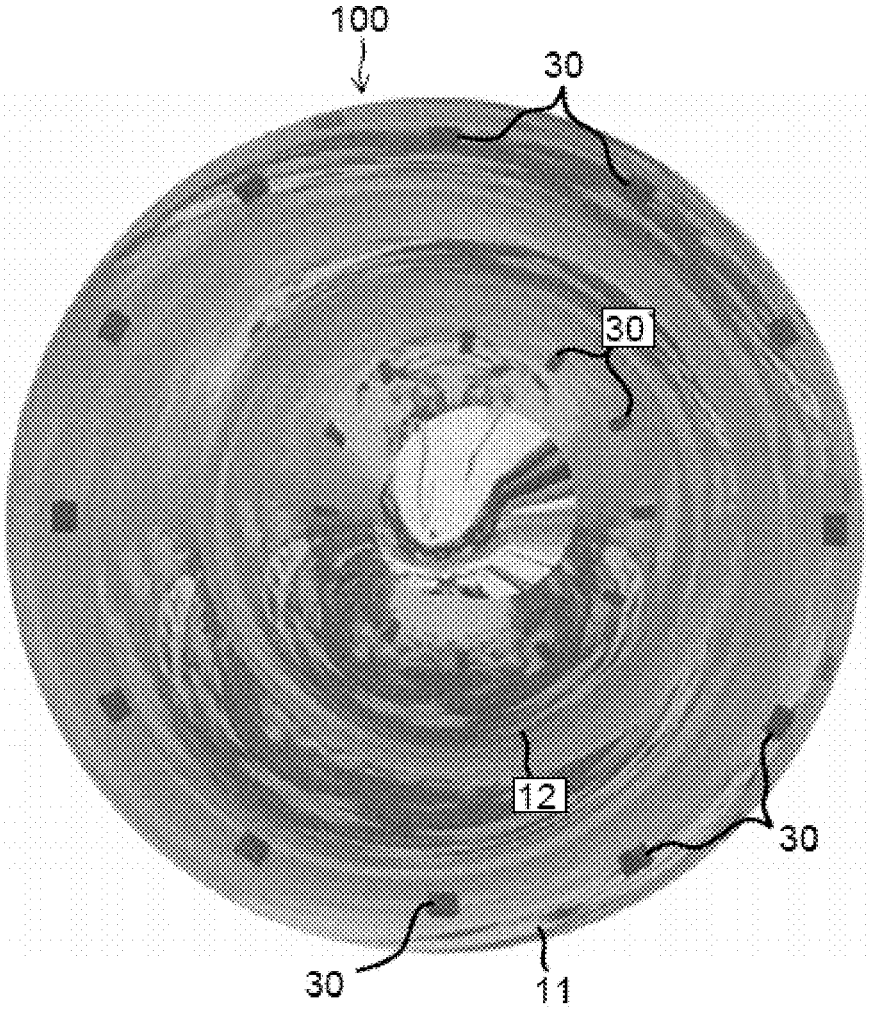
FIG. 11 shows an example of a pattern formed by a virtual image projected on a convex reflective surface of the lamp shown in FIG. 10.
Figure 12:
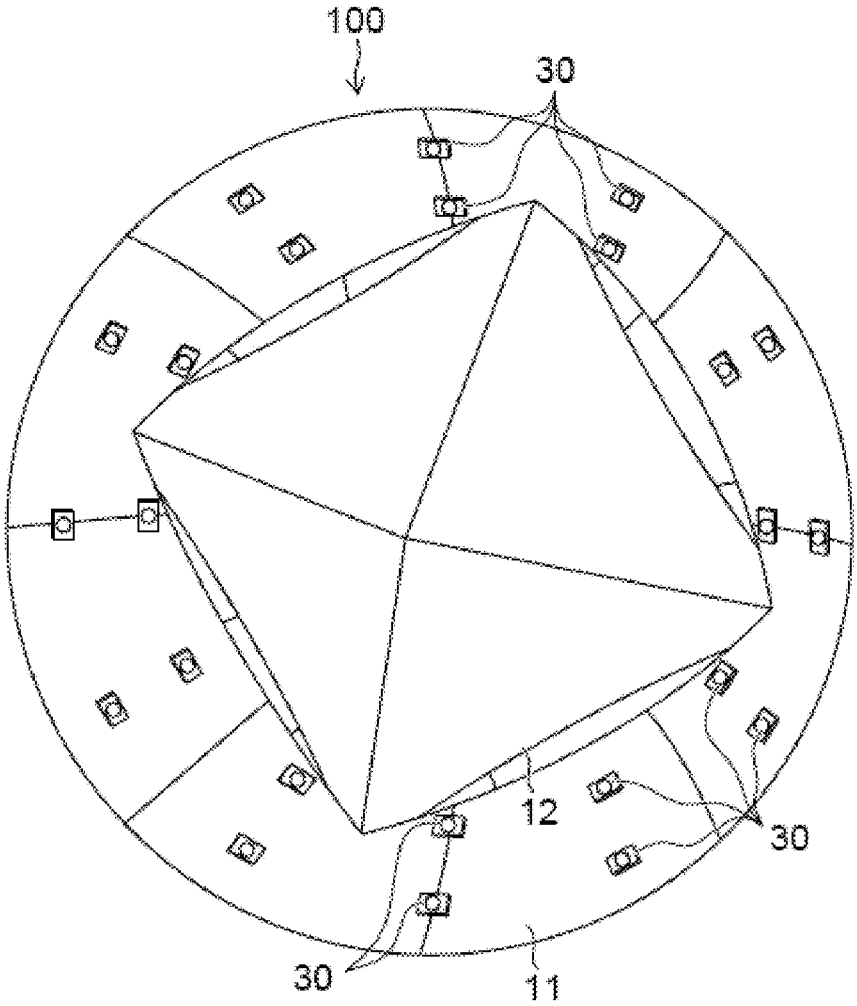
FIG. 12 is a perspective view of a lamp according to another embodiment (Modified Example 2) of the presently described subject matter.
Figure 13:
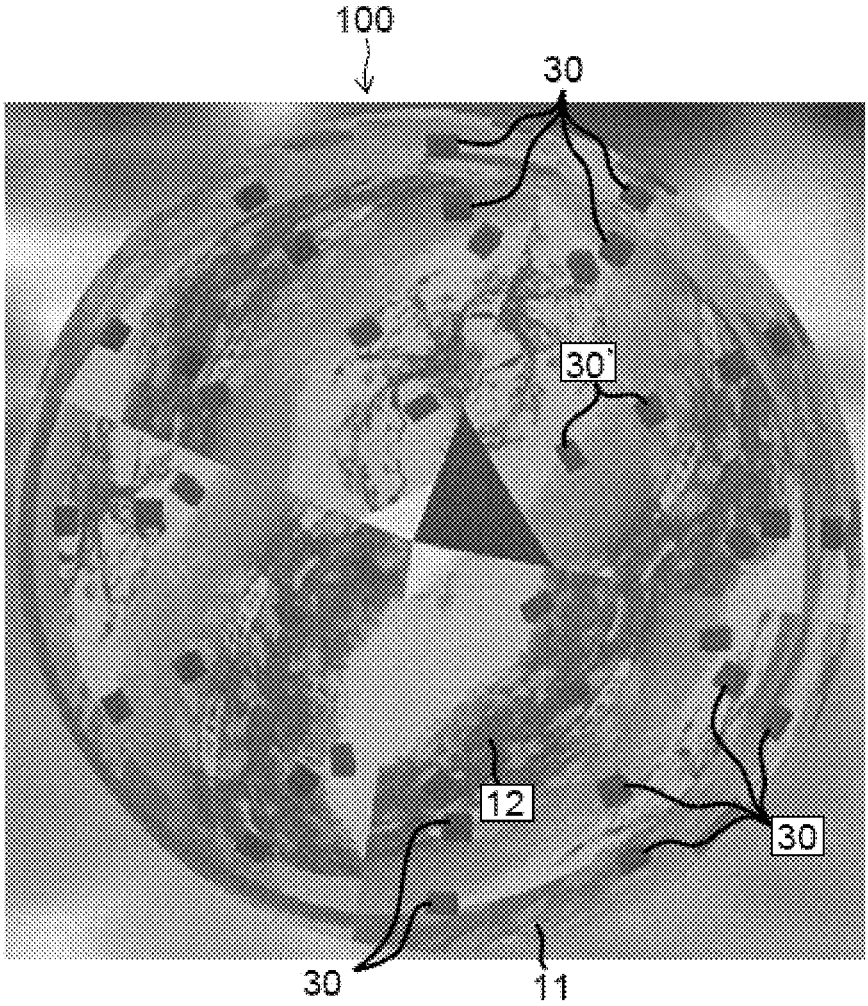
FIG. 13 shows an example of a pattern formed by a virtual image projected on a convex reflective surface of the lamp shown in FIG. 12.
Figure 14:
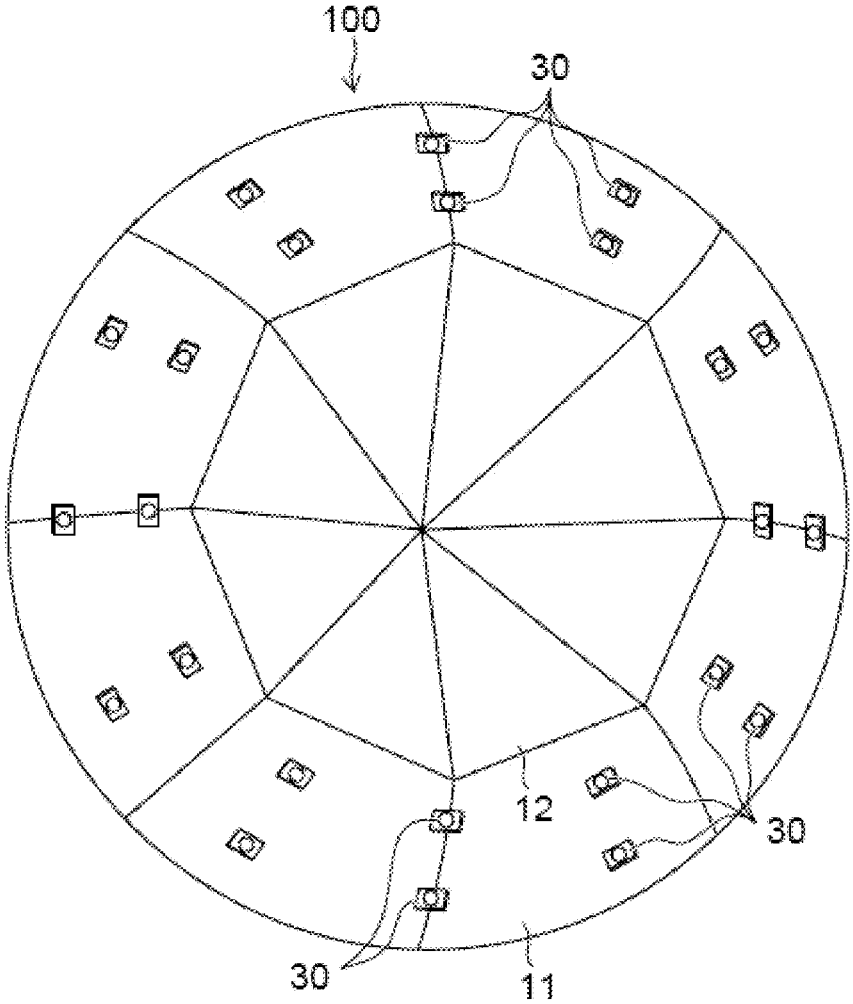
FIG. 14 is a perspective view of a lamp according to another embodiment (Modified Example 2) of the presently described subject matter.
Figure 15:
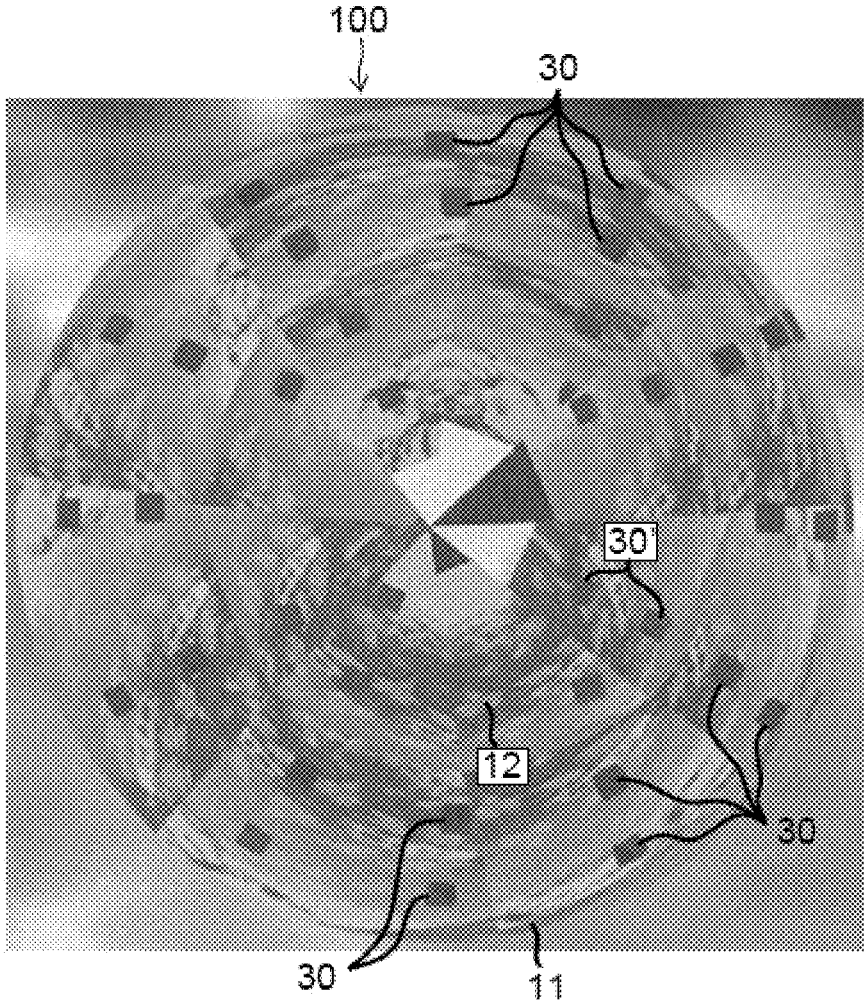
FIG. 15 shows an example of a pattern formed by a virtual image projected on a convex reflective surface of the lamp shown in FIG. 14.

For example, as shown in FIGS. 10, 12 and 14, the first light sources 30 can be annularly arranged on the concave reflective surface 11 around the convex reflective surface 12. FIGS. 11, 13 and 15 show patterns formed by the annularly arranged first light sources 30 being projected on the convex reflective surface 12 shown in FIGS. 10, 12 and 14, respectively. Each pattern shown in FIGS. 11, 13 and 15 changes its appearance according to viewpoint positions of an observer. The first light sources 30 can be projected on the convex reflective surface 12. Reference numeral 30' in the FIGS. 11, 13 and 15 represents the projected image of the first light sources 30. The number of the first light sources 30 can appear to be doubled. The pattern can be changed by changing the shape of the convex reflective surface 12.

Modified Example 1 can also provide a lamp which can form a pattern with an appearance changing according to the viewpoint positions of an observer, can form a predetermined light distribution pattern (particularly a light distribution pattern suitable for a vehicle signal lamp), and can have a new light emission appearance.

Next, Modified Example 2 will be described.

In the above-described embodiment, the example in which the convex reflective surface 12 is formed as the conical reflective surface has been described (see FIGS. 1 and 3), but the presently described subject matter is not limited thereto. For example, as shown in FIGS. 12 and 14, the convex reflective surface 12 can be formed as a polygonal pyramidal reflective surface. Even when the convex reflective surface 12 has a polygonal pyramidal shape as in FIGS. 12 and 14, the convex reflective surface 12 can be determined by the same determination method of the convex reflective surface 12 as described in the above-described embodiment.

Modified Example 2 can also provide a lamp which can form a pattern with an appearance changing according to the viewpoint positions of an observer, can form a predetermined light distribution pattern (particularly a light distribution pattern suitable for a vehicle signal lamp), and can have a new light emission appearance.

Next, Modified Example 3 will be described.

Figure 16:
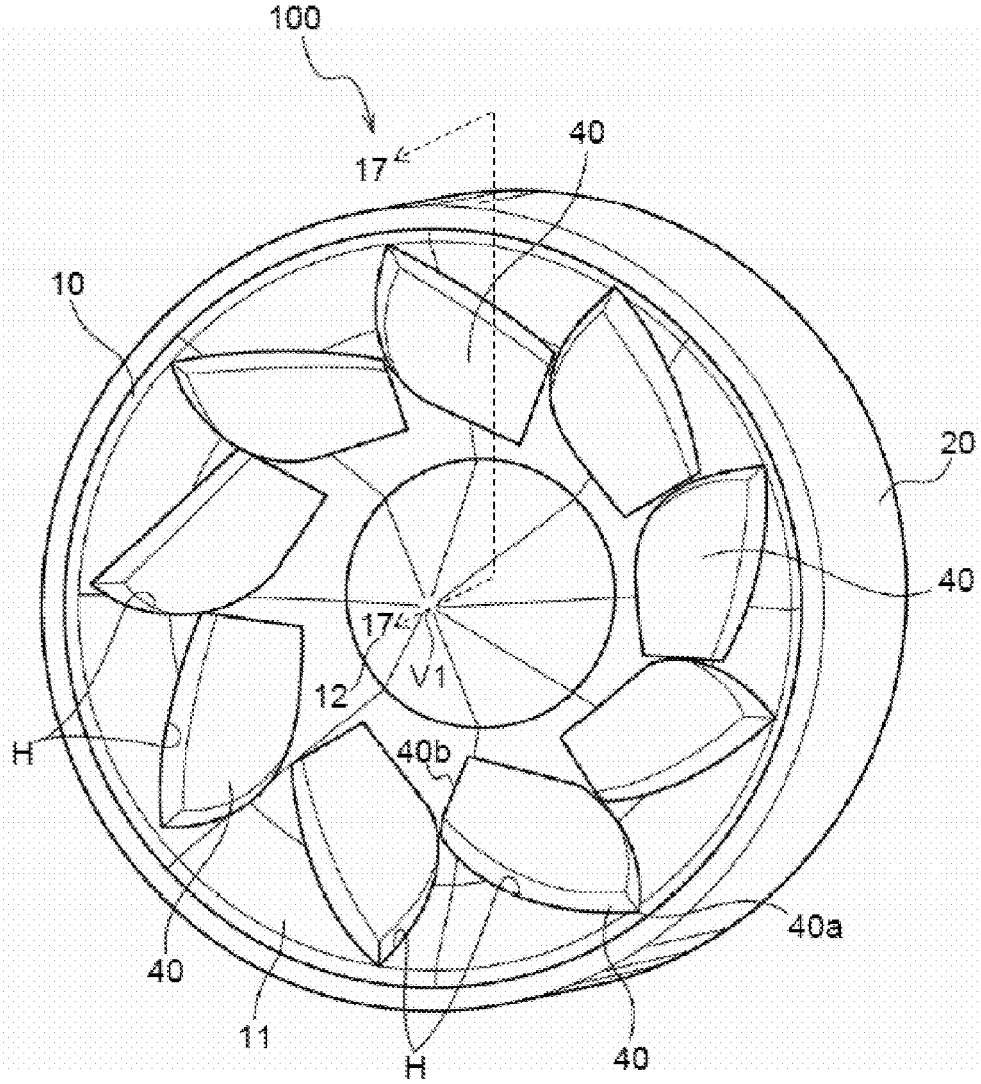
FIG. 16 is a perspective view of the lamp according to the another embodiment (Modified Example 3) of the presently described subject matter.
Figure 17:
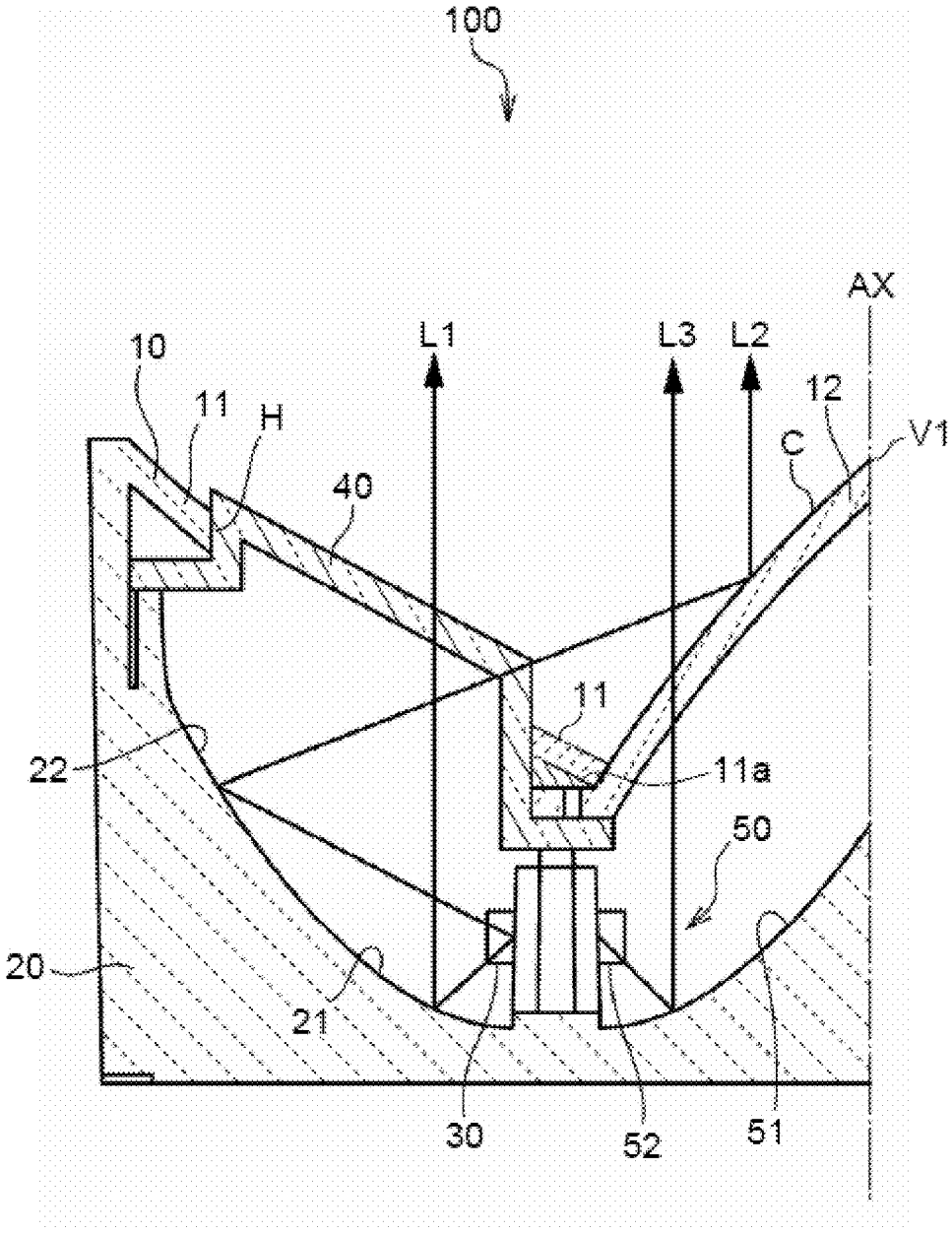
FIG. 17 is an enlarged sectional view of a lamp along line 17-17 shown in FIG. 16.
Figure 18:
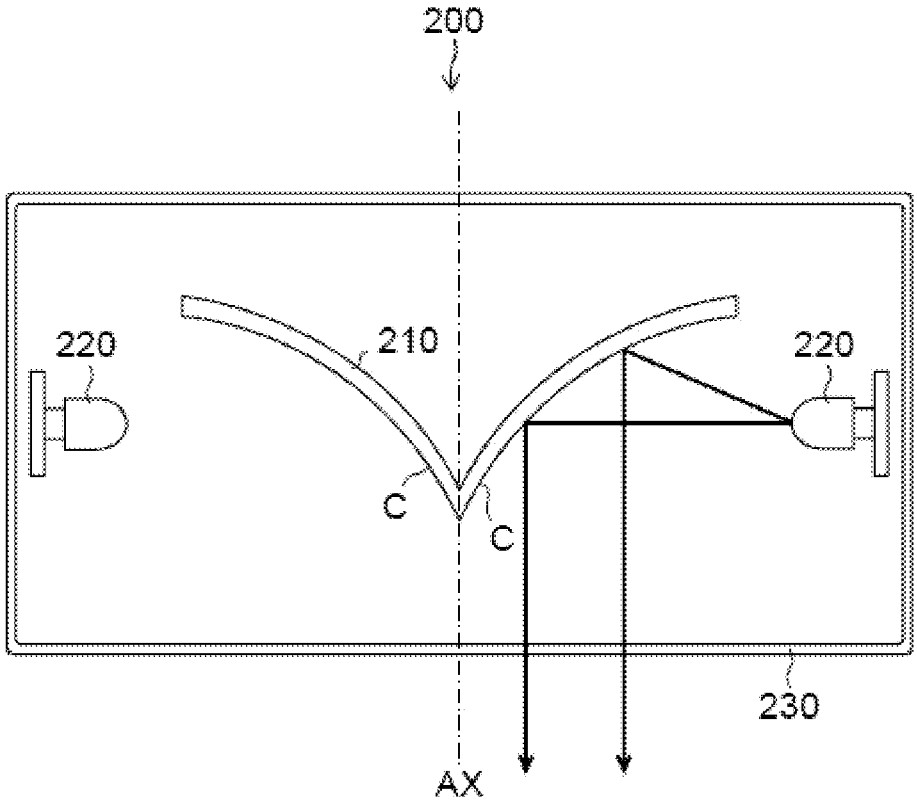
FIG.18 CONVENTIONAL ART
FIG. 18 is a sectional view for illustrating a configuration of a conventional vehicle lamp.

FIG. 16 is a perspective view of the lamp (Modified Example 3) according to another embodiment of the presently described subject matter. FIG. 17 is an enlarged sectional view of a lamp 100 along line 17-17 shown in FIG. 16.

As shown in FIG. 17, Modified Example 3 is an example in which an optical system 50 is added to the lamp 100 of FIG. 3 described above.

The optical system 50 can include a third reflective surface 51, a plurality of second light sources 52, and the convex reflective surface 12.

The third reflective surface 51 can reflect an irradiation light L3 incident from a second light source 52 toward the convex reflective surface 12. The third reflective surface 51 can be, for example, formed on the second reflector 20 in an integrated fashion. The third reflective surface 51 can be, for example, a paraboloid of revolution obtained by rotating a parabola having a focus positioned at or adjacent the second light source 52 around the lamp optical axis AX.

The convex reflective surface 12 can be a conical (or polygonal pyramidal) reflective surface with a curved line C that can appear to protrude outwardly with respect to the center thereof (or a straight line) when cut along a plane through the vertex V1 and the optical axis AX (centerline). Alternatively, the conical (or polygonal pyramidal) reflective surface can appear as a straight line, instead of as a curved line, when viewed in this cross-section. The convex reflective surface 12, for example, can be formed as a reflective surface through which the light reflected from the third reflective surface 51 and incident on the convex reflective surface 12 can pass. The convex reflective surface 12 can be made by performing vapor deposition of metal such as aluminum on a front or back surface of a conical (or polygonal pyramidal) transparent member (for example, acryl or polycarbonate). The convex reflective surface 12 can be, for example, fixed to an opening periphery 11*a* formed at the center of the bottom of the concave reflective surface 11 by any known fixing device, such as threaded fastener, etc.

The second light source 52 can be, for example, an LED light source such as an LED package including one or more LED chips (monochrome or three color RGB) in a package, or a bulb light source such as an incandescent light bulb. When the second light sources 52 are LED light sources, for example, the second light sources 52 can be annularly arranged with an optical axis (illumination direction) directed inwardly with respect to the center of the convex reflective surface 12 as shown in FIG. 17.

As shown in FIG. 16, the inner lens 40 can be formed to be radially wider than the inner lens 40 described in the above-described embodiment illustrated in FIG. 1 to increase an amount of light.

Modified Example 3 can provide a lamp which can form a pattern with an appearance changing according to viewpoint positions of an observer, can form a predetermined light distribution pattern (particularly a light distribution pattern suitable for a vehicle signal lamp), and can have a new light emission appearance.

Also, according to the lamp 100 of Modified Example 3, the convex reflective surface 12 can be formed as the reflective surface through which the light reflected from the third reflective surface 51 and incident on the convex reflective surface 12 can pass. Thus, as shown in FIG. 17, the irradiation light L3 from the second light source 52 incident on the third reflective surface 51 can be reflected by the third reflective surface 51, can pass through the convex reflective surface 12, can be irradiated in a direction indicated by L3 in FIG. 17, and can form a third light distribution pattern (particularly a light distribution pattern suitable for a vehicle signal lamp) superimposed on the first and second light distribution patterns.

Specifically, according to the lamp 100 of Modified Example 3, the third light distribution pattern formed by the irradiation light L3 (see FIG. 17) from the second light source 52 can be provided in addition to the first and second light distribution patterns formed by the irradiation lights L1 and L2 (see FIGS. 3 and 17) from the first light source 30.

Thus, for example, when the lamp 100 of Modified Example 3 is applied to a tail lamp of a vehicle, for example, the light sources 30 and 52 can be controlled so that, for example, only the first light source 30 is turned on when a brake of the vehicle is not applied, and both the first light source 30 and the second light source 52 are turned on when the brake is applied. Thus, a sufficient amount of light can be ensured even when the brake is applied. Therefore, the lamp 100 of Modified Example 3 can allow formation of a light distribution pattern which can satisfy a government standard.

The above-described embodiments are just some of the examples of the presently disclosed subject matter. The scope of the presently described subject matter should not be restrictively construed by these embodiments and examples. The presently described subject matter can be carried out in various ways without departing from the spirit and main features thereof.

While there has been described what are at present considered to be exemplary embodiments of the invention, it will be understood that various modifications may be made thereto, and it is intended that the appended claims cover such modifications as fall within the true spirit and scope of the invention. All conventional art references described above along with any English translations thereof are herein incorporated in their entirety by reference.

What is claimed is:

1. A lamp comprising:

a first reflector including a concave reflective surface and a convex reflective surface with the convex reflective surface located at a bottom of the concave reflective surface;

a second reflector wherein the first reflector is located inside the second reflector, and the second reflector includes a first reflective surface and a second reflective surface;

a plurality of first light sources located between the first reflector and the second reflector, each of the plurality of first light sources having an optical axis directed outward with respect to a center of the lamp; and a lens located on the concave reflective surface, wherein (i) the first reflective surface of the second reflector is configured to direct light from at least one of the plurality of first light sources toward a portion of the lens corresponding to the first reflective surface, and (ii) the second reflective surface of the second reflector is configured to direct light from at least one of the plurality of first light sources through a portion of the lens corresponding to the first reflective surface to reflect off the convex reflective surface.

2. The lamp according to claim 1, wherein the second reflective surface is a straight line in a cross-section view of the second reflective surface taken along a lamp optical axis and passing through a vertex of the second reflective surface; and, the first reflective surface is a curved line in a cross-section view of the first reflective surface taken along the lamp optical axis and the curved line being concave inward with respect to the center of the lamp.

3. The lamp according to claim 1, wherein the concave reflective surface is a straight line in a cross-section view of the concave reflective surface taken along a lamp optical axis passing through a vertex of the first reflector; and the convex reflective surface is a curved line in a cross-section view of the convex reflective surface taken along the lamp optical axis and the curved line being convex outward with respect to the center of the lamp.

4. The lamp according to claim 1, wherein the lens includes a first end portion having an acute angle, and a second end portion on an opposite side with respect to the first end portion, and the first end portion is located closer to an outer peripheral edge of the concave reflective surface, and the second end portion is located closer to a bottom of the convex reflective surface.

5. The lamp according to claim 1, wherein the plurality of first light sources includes an LED light source.

6. The lamp according to claim 1, wherein each of a plurality of first reflective surfaces corresponds to a respective one of the first light sources, is arranged adjacent to a back side of the first reflector, and is configured to reflect light irradiated from the respective first light sources and to direct the light along the optical axis of the lamp.

7. The lamp according to claim 1, further comprising:

a plurality of second light sources adjacent to a back side of the first reflector; and a plurality of third reflective surfaces each of which corresponds to a respective one of the second light sources, is arranged adjacent to a back side of the first reflector, and reflects light irradiated from the respective second light source to direct the light along the optical axis of the lamp, wherein the convex reflective surface is configured to transmit light incident on a back side thereof.

8. The lamp according to claim 7, wherein the second light sources are annularly arranged around the optical axis of the lamp at a predetermined interval, and irradiate light inwardly with respect to the center of the lamp.

* * * * *